United States Patent [19]

Abraham

[11] 4,267,706

[45] May 19, 1981

[54] SHOP AROUND REFRIGERATED MERCHANDISER

[75] Inventor: Fayez F. Abraham, Niles, Mich.

[73] Assignee: Tyler Refrigeration Corporation, Niles, Mich.

[21] Appl. No.: 44,021

[22] Filed: May 31, 1979

[51] Int. Cl.[3] ..... A47F 3/04

[52] U.S. Cl. ..... 62/256

[58] Field of Search ..... 62/256

[56] References Cited

U.S. PATENT DOCUMENTS

| | | | |
|---|---|---|---|
| 2,929,227 | 3/1960 | Rainwater | 62/256 |
| 3,009,333 | 11/1961 | Rainwater | 62/256 |
| 3,115,019 | 12/1963 | Rutishauser | 62/256 |
| 3,287,929 | 11/1966 | Beckwith | 62/256 |
| 3,306,068 | 2/1967 | Allgeyer et al. | 62/256 |
| 3,365,907 | 1/1968 | Barroero | 62/256 |
| 3,365,908 | 1/1968 | MacMaster | 62/256 |
| 3,392,543 | 7/1968 | Miller | 62/256 X |
| 3,403,525 | 10/1968 | Beckwith et al. | 62/256 X |
| 3,593,538 | 7/1971 | Bachman | 62/256 |
| 3,771,323 | 11/1973 | Simons et al. | 62/256 X |
| 3,850,003 | 11/1974 | Beckwith et al. | 62/256 |
| 3,937,033 | 2/1976 | Beckwith et al. | 62/256 X |
| 4,144,720 | 3/1979 | Subera et al. | 62/256 |
| 4,145,893 | 3/1979 | Vogel | 62/256 |

*Primary Examiner*—Lloyd L. King

*Attorney, Agent, or Firm*—LeBlanc, Nolan, Shur & Nies

[57] ABSTRACT

A refrigerated display case having a front opening for enabling access to products within the display case from a plurality of angular positions with respect to the display case. In order to more readily enable the consumer to obtain access to products within the display case, the opening circumscribes an angle of at least 90° or alternatively, the opening within the case extends continuously through the case so that the case has openings on opposing sides. The refrigerated display case includes a cabinet having top and bottom sections with an air conduit portion interconnecting and extending into the top and bottom sections. Either a single air conduit or two air conduits can be utilized. Arranged within the first air conduit is a refrigeration mechanism and air is circulated through that conduit for providing a band of refrigerated air which includes an inner air curtain across the opening in the case, for cooling the product in the display case. If a second air conduit is included within the display case, that conduit serves to provide a secondary band of air which establishes an outer air curtain across the opening in the display case. The display case is also provided with an ambient air defrost system so that ambient air is drawn through the first air conduit for defrosting the refrigeration mechanism. Finally, the refrigerated display case also can be provided with a compressor unit and a condenser unit so that the case is in effect a self-contained unit.

13 Claims, 17 Drawing Figures

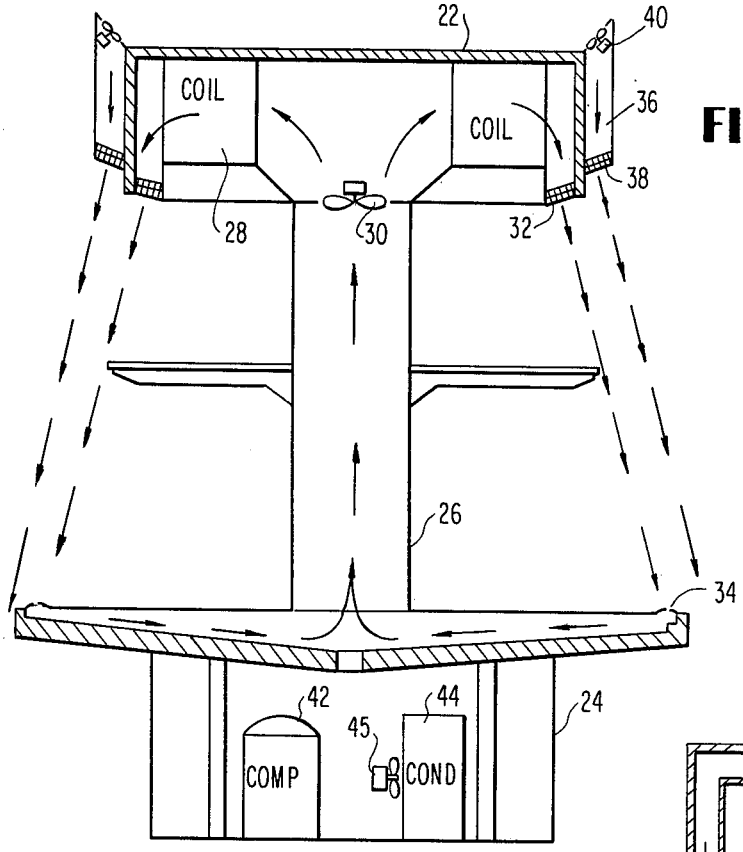
FIG. 3
FIG. 4
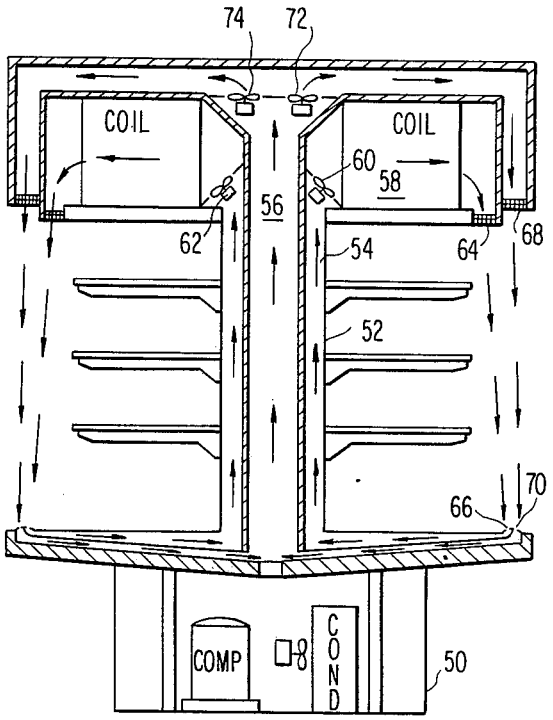
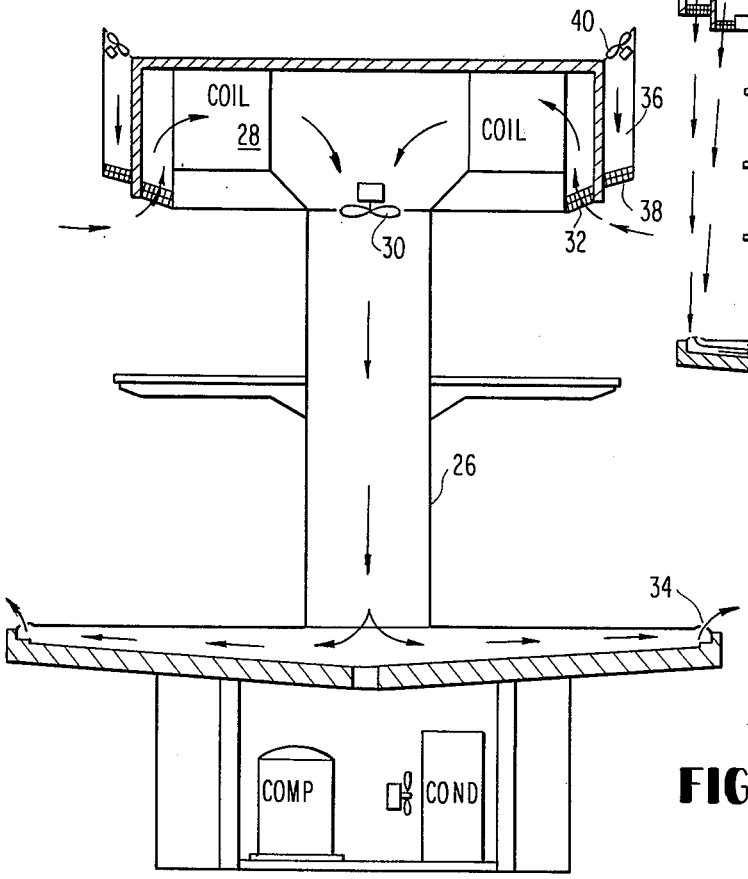
FIG. 5

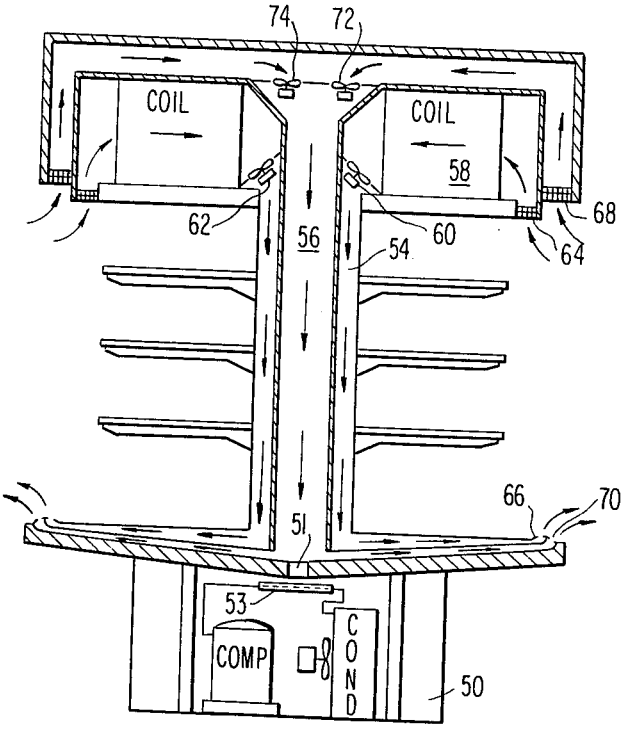
FIG. 6
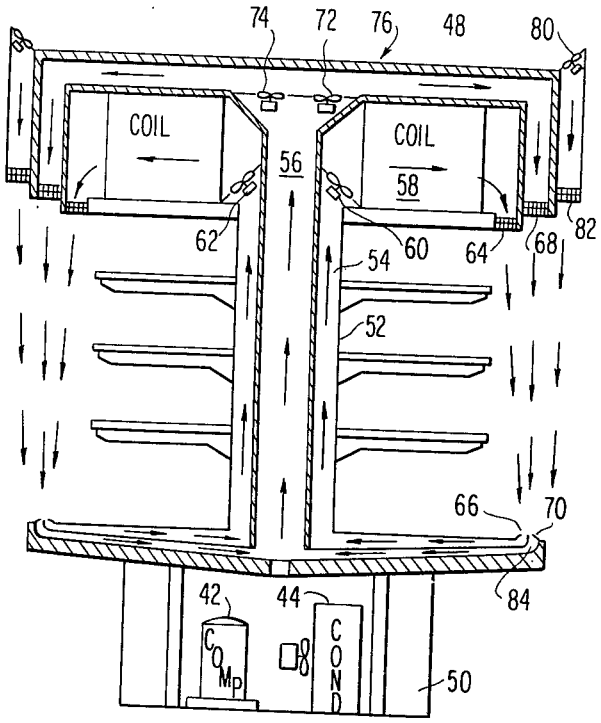
FIG. 7
FIG. 8
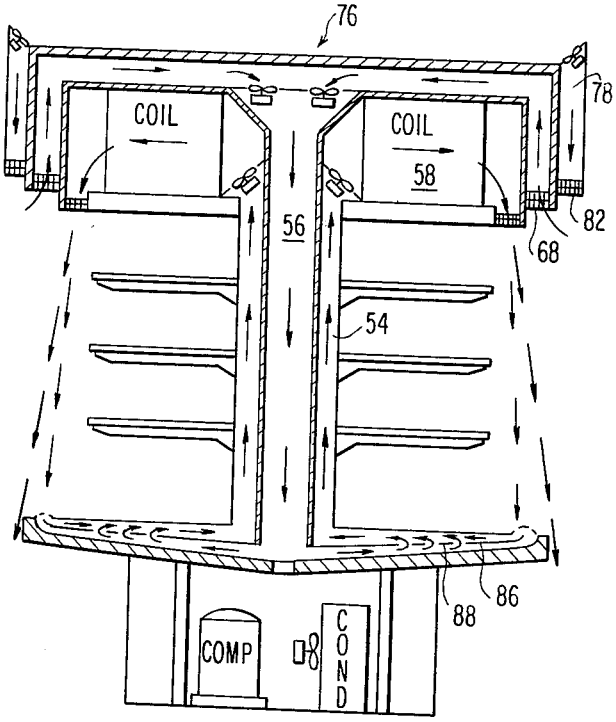
FIG. 9
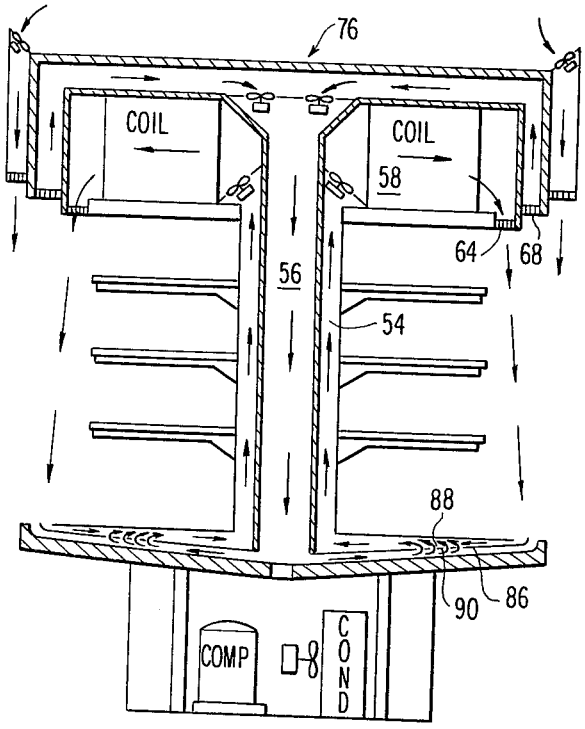

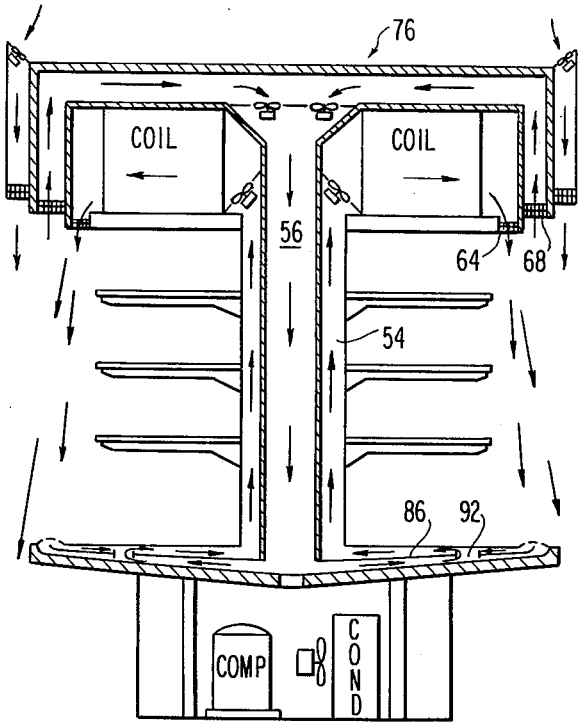
FIG. 10a
FIG. 10b
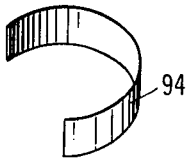
FIG. 11
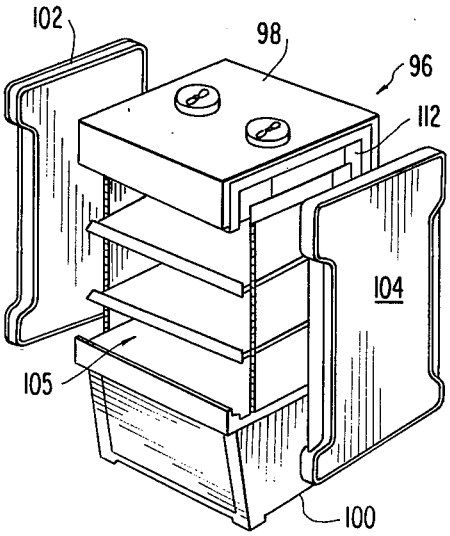
FIG. 12
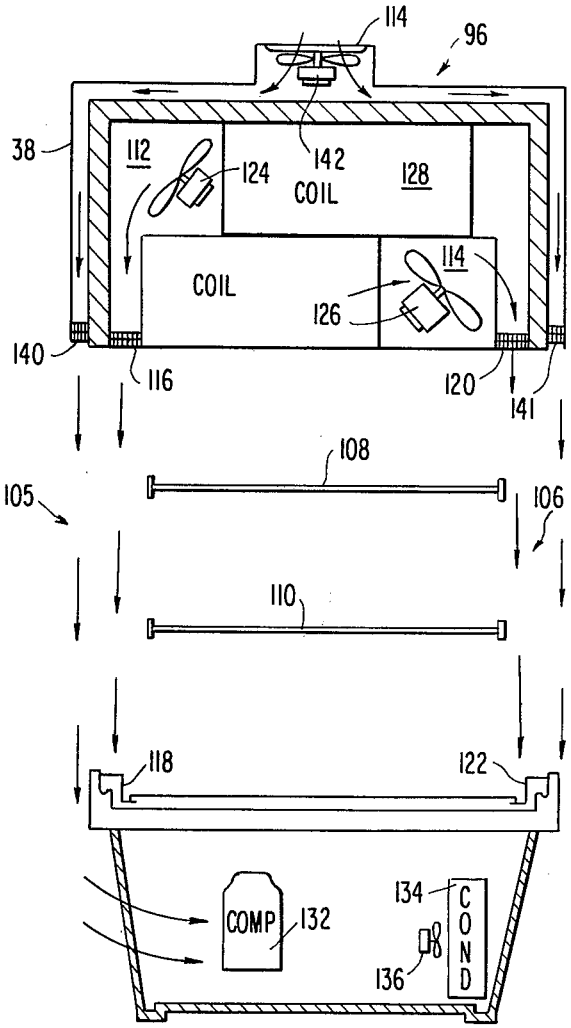

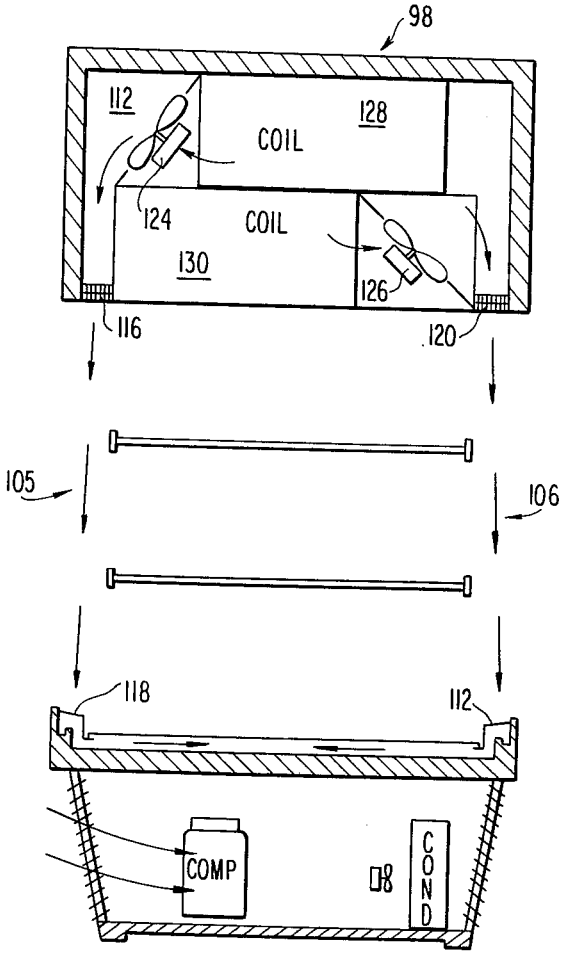
FIG. 13
FIG. 14a
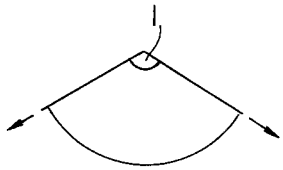
FIG. 14b
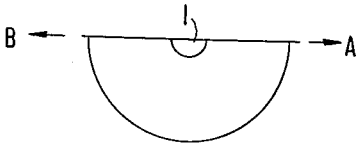
FIG. 14c
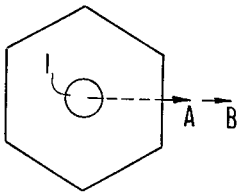

SHOP AROUND REFRIGERATED MERCHANDISER

BACKGROUND OF THE INVENTION

The present invention relates to a shop around refrigerated display case in which a consumer has access to products within the display case from a plurality of angular positions with respect to the display case.

The terms "refrigerated" and "refrigeration" as used throughout both the specification and claims of the present application are intended to refer to display cases maintained at temperatures both in excess of 32° F., such as dairy food and fresh meat display cases, and below 32° F., such as frozen food cases.

Most refrigerated display cases typically in use today are of a generally rectangular form having an access opening on only one side. A plurality of such cases are set up within a store extending along a plurality of rows. The condensers and compressors for such cases are generally mounted in a location separate from the cases with piping to the cases running under the floor of the store. While such display cases are fully acceptable for the majority of the displays within a store, particularly in the larger stores, such cases inherently lack a certain degree of versatility and flexibility. Since the piping for such display cases is prearranged under the floor of the store, there is no possibility for setting up spot displays within the store. In addition, such cases are set up in back-to-back arrangements with the access only being from one side. While it is often desirable to place additional refrigerated display units at the ends of such rows of cases, the only type of case typically available is another rectangular unit merely open from one side. Both the accessibility to the refrigerated products within the case and the maximum utility of space is significantly hampered by such an arrangement. In addition, such display cases only provide access to the consumer from one side of the case. In many situations, especially when there is limited space within the store, it is desirable if the consumer could have access to the products within the case from both sides of the case, or even more preferably, from all sides of the case.

In order to overcome some of the above-noted drawbacks of the typically utilized rectangular refrigerated display cases, various types of shop around refrigerated display cases have been developed. Exemplary of such cases are those illustrated in U.S. Pat. Nos. 2,929,227 to Rainwater; 3,009,333 to Rainwater; 3,115,019 to Rutishauser; 3,306,068 to Allgeyer et al.; 3,365,907 to Barroero; and 3,392,543 to Miller. Both of the patents to Rainwater illustrate open top refrigerated display cases having two compartments where air flows through a centrally located conduit that separates the two compartments. The patent to Miller illustrates two open-front display cases arranged in a back-to-back relationship with the cases sharing a common centrally located air conduit. The patents to Rutishauser, Barroero and Allgeyer et al illustrate self-contained refrigerated display cases presenting a 360° opening for access into the case. The circular display cases illustrated in the patents to Rutishauser and Barroero contain complex air-flow paths in which the refrigerated air flows out of openings within each of the shelves spaced along the longitudinally extending conduit. The circular display case illustrated in the patent to Allgeyer et al. includes a single air conduit for providing a single refrigerated air curtain across the opening in the display case.

In summation, all of the above-noted patents either disclose refrigerated display cases in which full access to the products within the display case is not available to the consumer or in rendering a display case which provides for wider access, the display cases contain complex air flow arrangements rendering the systems significantly less efficient in properly maintaining refrigeration of the products within the display case. The difficulty of properly refrigerating the products is particularly significant due to the extensive open area with such circular display cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to automatically switch between a refrigeration cycle and a defrost cycle of operation. In this manner of operation, it is possible to avoid any significant frost buildup within the display case.

Typically within the prior art, there have been three different approaches employed for defrosting refrigerated display cases. The three approaches include: utilizing electric resistance heaters; passing a compressed gaseous refrigerant through the refrigeration coils; and, circulating ambient air through the air conduit. Due to the increasing cost of energy in recent years, efforts have been made to place more emphasis on the utilization of ambient air defrost systems in place of the electrical resistence heaters or compressed gaseous refrigerant defrost systems.

One type of system that employs ambient air during the defrost cycle is exemplified by those embodiments illustrated in U.S. Pat. Nos. 3,403,525, 3,850,003 and 3,937,033, all to Beckwith, et al. These systems use fans separate and distinct from the main circulating fans. The additional fans are turned on only during the defrost cycle of operation for pulling ambient air from outside of the display case directly into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith, et al. U.S. Pat. No. 3,850,003 indicates that the concepts described in U.S. Pat. Nos. 3,082,612 and 3,403,525 did not prove to be practical and hence were not commercially feasible.

Another type of ambient air defrosting system is shown in U.S. Pat. No. 4,144,720 to Subera, et al., which is assigned to the same assignee as the present application. In the foregoing patent application, an open front refrigerated display case having primary and secondary air conduits is disclosed. In this system, the direction of air flow within one of the conduits is reversed, for example, by the use of reversible fans for ambient air defrost. U.S. Pat. No. 4,026,121 to Aokage et al., which illustrates an open front display case, and U.S. Pat. No. 4,120,174 to Johnston, which illustrates an open top display case, also disclose reverse ambient air flows for defrosting.

SUMMARY OF THE INVENTION

An object of the present invention is to provide an improved shop around refrigerated display case.

Another object of the present invention is to provide a shop around refrigerated display case that has an improved and more efficient operation than previously available shop-around display cases such as those discussed above in connection with the prior art patents.

A further object of the present invention is to provide a multiband shop around display case in which the refrigerated air band is shielded from the ambient air surrounding the display case.

Still another object of the present invention is to provide an improved shop around refrigerated display case having an access opening of at least 90° and preferably at least 120°.

Still a further object of the present invention is to provide an improved shop around refrigerated display case having an access opening extending through 360°.

A still further object of the present invention is to provide a shop around refrigerated display case having an access opening extending through the case from one side of the case to the other side of the case so that products stored within the case are fully accessible from either of the opposing sides of the case.

Another object of the present invention is to provide a shop around refrigerated display case having an ambient air defrost system.

A further object of the present invention is to provide an improved shop-around refrigerated display case that can be used to form a display at the end of a gondola within a store.

A still further object of the present invention is to provide an improved shop around refrigerated display case in which condensation and frost buildup at the air inlets of the refrigerated air conduit is substantially minimized without the necessity of utilizing anti-sweat heater wires.

A further object of the present invention is to provide an improved shop around refrigerated display case having its own compressor and condenser units so that the case is a self-contained system.

The above-noted objectives are achieved by the construction of a shop around refrigerated display case in accordance with the present invention. The term "shop around refrigerated display case" as used throughout the entire specification is intended to refer to an upright open-front refrigerated display case in which access to the products within the display case can be obtained at a plurality of different angular positions with respect to the case. This can be achieved either through a case having a single opening extending over an angle of at least approximately 90° or a case having an opening that extends continuously through the case from one side to the other opposing side so that access to the products within the case can be obtained from either of the opposing sides.

In those cases in which there is only a single access opening, a case is formed in a cabinet having top and bottom sections with a conduit interconnecting and extending into such sections. The conduit has a vertical portion that is located along an axis corresponding to the center of radius of the cabinet. Thus, looking at FIGS. 14*a*, 14*b* and 14*c* of the drawings, all of which show schematic illustration of cross sections of various display cases, the meaning of the angular relationship described herein can be more fully appreciated. In FIG. 14*a*, the cross section of the display case is in the form of a section from a circle with the conduit 1*a* being located at the center of radius of the circle and extending out from the conduit are the two side walls of the display case that lie along axes A and B so that the opening in the case, which is the angle between axes A and B is 120°. Looking now at FIG. 14*b* it can be seen that the angle between Axis A and axis B is 180° and in FIG. 14*c*, axis B has in essence made a complete circle and now overlaps axis A so that the opening is 360°. As illustrated in those drawings, the cross section of the display case can either be circular or hexagonal or any other similar shape with the shape merely being determined by the shape of the individual shelves that are mounted so as to circumscribe the conduit.

In accordance with a first embodiment of the refrigerated display case of the present invention, the case has a cabinet with top and bottom sections and an air conduit that couples the top and bottom sections and also extends into those sections. The cabinet has a front opening that circumscribes an angle of at least 90° and can extend up to 360°. The air conduit has a vertically extending portion which is located approximately at the center of radius of the cabinet. The air conduit includes first and second air conduit sections each of which has outlet and inlet openings arranged at opposite ends thereof. The air outlet and inlet openings are positioned in a line for establishing air curtains across the openings in the cabinet. The first air conduit section serves to establish an inner air curtain and the second air conduit section serves to establish an outer air curtain. The two air conduit sections can be arranged concentrically within the vertically extending portion of the air conduit with the first air conduit section surrounding the second air conduit section. The second air conduit section extends both above and below the first section so as to overlap and be capable of forming the outer air curtain. Arranged within the first air conduit section is either a single or plurality of evaporator coils for refrigerating the air circulated through that conduit section. As air is propelled through the first conduit section, the air is refrigerated, emitted from the first conduit section, travels across the opening in the display case so as to form an inner air curtain and then returns to the first conduit section for recirculation and to again be refrigerated thereby establishing a continuous refrigerated air band. The air propelled through the second air conduit section leaves that section through an outlet opening so as to form an air curtain lying outwardly of the inner refrigerated air curtain. The outer air curtain is then received back into an inlet opening of the second air conduit section for recirculation. The outer air curtain serves to protect the inner air curtain from ambient air thereby substantially minimizing possible warming effects on the inner air curtain by the ambient air and increasing the efficiency of operation of the display case. In a modified form of this embodiment, it is also possible to establish a third air curtain across the opening in the display case. This third air curtain would be positioned outwardly of the air curtain formed by the air emitted from the second air conduit section. The third air curtain is a curtain of purely ambient air which is propelled across the opening in the display case but is not received back into either of the air conduit sections of the display case.

In another modified embodiment, only a single air band, which is a refrigerated air band, is established within the display case. However, a curtain of ambient air is propelled across the opening in the display case to serve as a protective air curtain for the inner refrigerated air curtain.

In any of the above-described embodiments, the access opening can vary between 90° and 360°. The evaporator coils for such cases are typically located in the top section of the display case. Since the top and also the bottom sections of the display case have essentially the same configuration as the opening of the display case, the evaporator coils can extend as a continuous unit through the top section of the case over the entire angular section. Alternatively, the evaporator coils can be located within the vertically extending portion of the air conduit, which then would allow for increased storage space since the top section of the display case could be substantially smaller in height. Of course, conversely, the vertical portion of the inner conduit would have to be larger so as to contain the evaporator coils.

Any of the display cases of the present invention can be constructed as self-contained units. For such a purpose, the display case would include its own compressor and condenser. The compressor and condenser would be located in the bottom section of the display case with the necessary piping running to the evaporator coils. For this purpose, the piping would run through the air conduit; the piping has not been shown in any of the attached drawings since it has been omitted for sake of clarity.

All of those specific embodiments described above preferably also include ambient air defrost systems. In all such systems, the objective is to cause ambient air from outside of the display case to flow through the refrigerated air conduit in order to defrost any frost buildup either on the evaporator coils or within the conduit itself. During such defrost operation, the refrigeration operation of the evaporator coils is temporarily deactivated.

Several different arrangements of the defrost system can be provided in accordance with the present invention. In one such system, the air flow through all of the outer air bands is terminated and the direction of air flow through the refrigerated air conduit is reversed. Due to the configuration of the conduits and the inlet and outlet openings, ambient air is drawn into the refrigerated air conduit during such a reverse air flow. The ambient air is passed through the conduit and then expelled at the opposite end in a direction up and away from the display case. In conjunction with such a system, it is possible to allow ambient air from an outer ambient air conduit to be expelled during the defrost operation since such ambient air then will be drawn into the refrigerated air conduit. In an alternative embodiment of the defrost system, the direction of air flow through both the first and second air conduits can be reversed with ambient air then being sucked into both conduits during the defrost operation.

In another possible embodiment, the direction of air flow through the refrigerated air conduit is maintained, although the evaporator coils are turned off, and ambient air is caused to flow through the second air conduit in a reverse direction. The ambient air flowing through the second air conduit is then diverted into the first air conduit and such ambient air serves to defrost the evaporator coils. The particular mechanism for diverting ambient air from the second to the first air conduit can vary. A plurality of perforations can be provided in a common wall between the two conduits for allowing the air to pass between the two conduits; alternatively, air diverting members can be arranged adjacent to the perforations for diverting the air from the second conduit into the first conduit.

In another type of embodiment in accordance with the present invention, the access opening within the display case extends from one side of the case through the case to the opposite side. In such an embodiment, the two other sides of the case are closed and the air conduits extend through such side walls. In this arrangement, the air is circulated through the air conduit which extends from the bottom portion of the case up through one of the side walls and into the top portion of the case. The air is then expelled from the conduit along a vertical path across the opening in the case and then returned back into that part of the conduit in the bottom portion of the case. Separate conduits can be provided for creating an air curtain across each of the open sides of the display case. Such conduits can be located in different ones of the side walls of the display case. In a modification of this embodiment of the present invention, an outer ambient air curtain can be provided by drawing in air from the top of the case and expelling such air along a vertical path outside of the refrigerated air band. With either of these embodiments, it is desirable to include an ambient air defrost system. With such a defrost system, the direction of air flow through the refrigerated air conduits would be reversed and ambient air would be drawn into such conduits in order to defrost the evaporator coils and other portions of the conduits.

BRIEF DESCRIPTION OF THE DRAWINGS

FIG. 3 is a sectional view along a longitudinal axis of one embodiment of the shop around refrigerated display case of the present invention.

FIG. 4 is a sectional view along a longitudinal axis of another embodiment of the shop around refrigerated display case of the present invention.

FIG. 5 is a view similar to FIG. 3, except that the display case is being operated in a defrost cycle of operation.

FIG. 6 is a view similar to FIG. 4 except that the display case is being operated in a defrost cycle of operation.

FIG. 7 is a sectional view along a longitudinal axis of another embodiment of the shop around refrigerated display case in accordance with the present invention.

FIG. 8 is a sectional view along a longitudinal axis of another embodiment of the shop around refrigerated di play case in accordance with the present invention, with the display case being operated in a defrost cycle of operation.

FIG. 9 is a sectional view along a longitudinal axis of another mbodiment of the shop around refrigerated display case in accordance wit the present invention, with the display case being operated in a defrost cycle of operation.

FIG. 10*a* is a sectional view along a longitudinal axis of another embodiment of the shop around refrigerated display case in accordance with the present invention, with the display case being operated in a defrost cycle of operation.

FIG. 10*b* is a perspective view of one of the air scoops utilized within the display case of FIG. 10*a*.

FIG. 11 is a perspective partially exploded view of another embodiment of the shop around refrigerated display case in accordance with the present invention.

FIG. 12 is a sectional view along a longitudinal axis of the shop around refrigerated display case illustrated in FIG. 11.

FIG. 13 is a sectional view along a longitudinal axis of a modified embodiment of the shop around refrigerated display case illustrated in FIG. 11.

FIGS. 14*a*, 14*b* and 14*c* are schematic cross-sectional illustrations of different forms of the shop around refrigerated display cases in accordance with the present invention.

DESCRIPTION OF THE PREFERRED EMBODIMENTS

Figure 1:
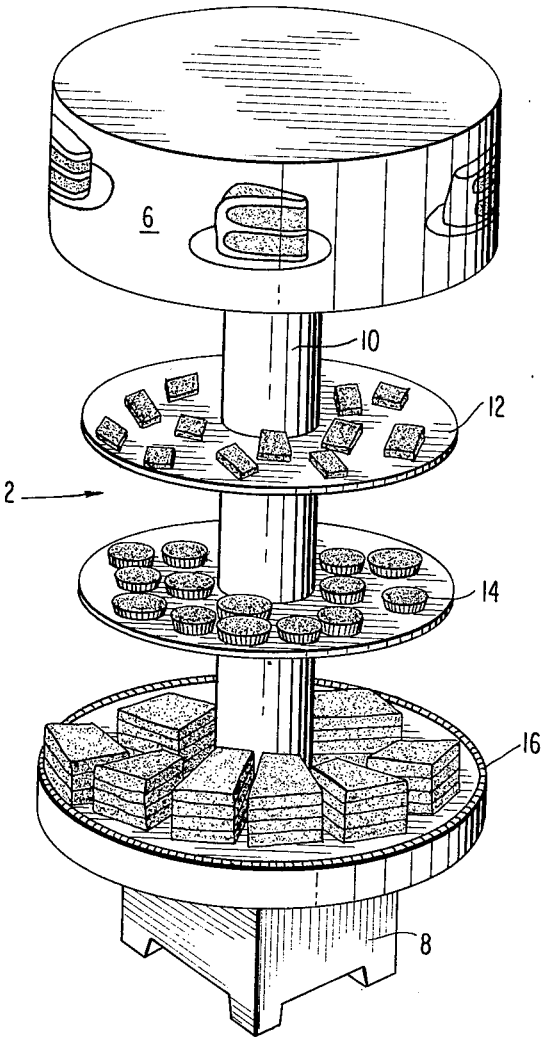
FIG. 1 is a perspective view of one embodiment of a shop around refrigerated display case in accordance with the present invention, which case has an access opening circumscribing an angle of 360°.
Figure 2:
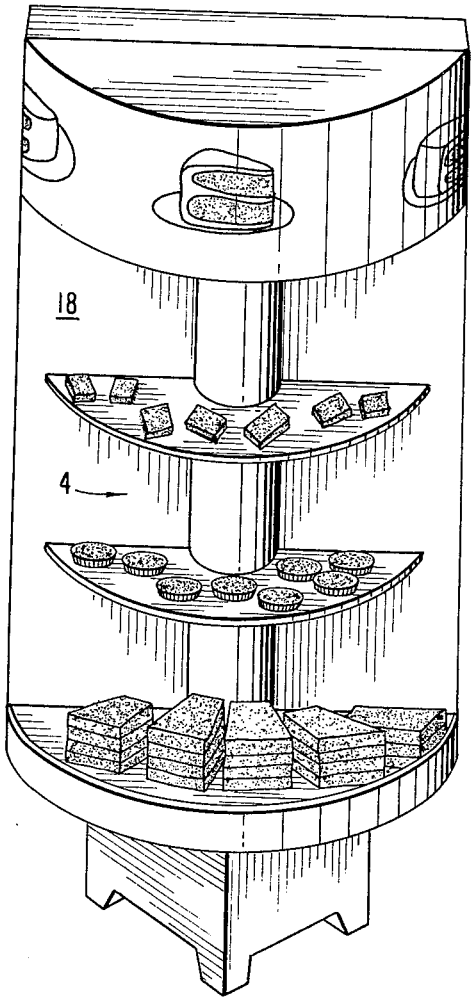
FIG. 2 is a perspective view of another embodiment of a shop around refrigerated display case in accordance with the present invention, which case has an access opening circumscribing an angle of 180°.

Although the shop around refrigerated display cases of the present invention can take many different shapes, two particular shapes are illustrated in FIGS. 1 and 2. A circular shop around refrigerated display case 2 is shown in FIG. 1 and a semicircular shop around refrigerated display case 4 is shown in FIG. 2. Shop around display case 2 has a top section 6 and a bottom section 8 which are interconnected by a conduit 10. Surrounding conduit 10 are a plurality of shelves 12, 14 and 16.

While circular shop around display case 2 is a free standing unit that can be placed anywhere in the store, semi-circular shop around display case 4 is intended to be placed at the end of a gondola or against a wall 18 in the store. The shop around cases of the present invention also can be rectangular or hexagonal.

In FIG. 3, there is illustrated a single conduit shop around display case 20. Display case 20 has a top section 22 and a bottom section 24. A single conduit 26 interconnects top section 22 and bottom 24 and extends into such sections. An evaporator coil 28, or a plurality of such coils, is arranged in the portion of conduit 26 in top section 22. A fan 30 arranged along the longitudinal axis of conduit 26 circulates air through the conduit and likewise through the evaporator coils. The air circulated in conduit 26 as it passes through the evaporator coils is refrigerated and is then emitted from outlet opening 32. The refrigerated air travels across the opening in the display case in a substantially vertical direction towards bottom section 24 where it is received back into conduit 26 through inlet opening 34. The air re-enters conduit 26 and is then recirculated through the conduit.

Arranged adjacent to the upper portion of conduit 26 but outwardly therefrom is an ambient air conduit 36. Air is circulated through ambient air conduit 36 by fan 40 which draws in ambient air from above the display case. The ambient air passing through conduit 36 is then emitted from outlet opening 38 and directed along a path adjacent to but spaced outwardly from the refrigerated air curtain. This ambient air curtain is directed so as to fall outside of the display case and the air does not enter inlet opening 34. This ambient air curtain serves as a shield to isolate the refrigerated air curtain from the surrounding atmosphere.

Arranged in the bottom of display case 20 is a compressor 42, a condenser 44, and an accompanying fan 45. With the inclusion of these members, display case 20 is a self-contained unit which can be placed anywhere in the store. In connection with all of the embodiments discussed and illustrated in the present application, similar compressors, condensers and fans can be provided in the bottom section of such display cases so that such cases are self-contained units.

While the display case illustrated in FIG. 3 is shown during a refrigeration cycle of operation, in FIG. 5 the same case is shown during a defrost cycle of operation. During a defrost cycle, the air flow through conduit 26 is reversed. The reversal of the air flow can be accomplished by changing the direction of operation of fan 30 if an appropriate type of fan is utilized. In addition, the evaporator coils are deactivated so that the air passing through conduit 26 is not refrigerated. As shown in FIG. 5, ambient air will be drawn into conduit 26 through outlet opening 32. The ambient air then circulates through conduit 26 and is expelled from the conduit to inlet opening 34. Such an air flow arrangement occurs both due to the configuration of the outlet and inlet openings of the air conduit and in addition due to the fact that the air expelled from the lower portion of the conduit has a natural tendency against flowing in an upward direction so as to be directed back into the conduit. The ambient air passing through conduit 26 serves to defrost the evaporator coil along with any frost buildup inside of conduit 26.

A two-band shop around refrigerated display case 46 is illustrated in FIGS. 4 and 6, which figures show the display case in its refrigeration cycle of operation and defrost cycle of operation, respectively. Display case 46 has a top section 48, a bottom section 50, and a conduit section 52 which interconnects the top and bottom sections and extends into such sections. Conduit section 52 includes two conduits, 54 and 56. Conduit 54 is the refrigerated air conduit and contains in its upper portion an evaporator coil 58. At opposite ends of conduit 54 are outlet opening 64 and inlet opening 66. Air is circulated through conduit 54 by a plurality of fans 60 and 62. As the air passes through conduit 54 it is refrigerated by evaporator coil 58. The refrigerated air is then emitted from outlet opening 64 in a substantially vertical direction so as to form a refrigerated air curtain across the opening in the display case. The refrigerated air then re-enters conduit 54 through inlet opening 66 and the air is recirculated.

The refrigerated air curtain is protected and shielded from the ambient air by a secondary air curtain that is formed across the access opening in the display case. This secondary air curtain, which is positioned outwardly of the refrigerated air curtain is generated by the air circulated through conduit 56. Fans 72 and 74 serve to circulate the air through conduit 56 which air is then emitted from outlet opening 68 in a substantially vertical direction. The air emitted from conduit 56 is received back into the conduit through inlet opening 70 so that it is again recirculated. The air circulated through conduit 56 is cooled since the conduit shares a common wall with refrigerated air conduit 54; however, the air passing through conduit 56 is not refrigerated before being emitted from outlet opening 68.

During a defrost cycle of operation of display case 46, the direction of air flow through both conduits 54 and 56 can be reversed such as shown in FIG. 6. Alternatively, the air flow through conduit 56 can be terminated during the defrost cycle of operation and the air flowing through conduit 54 can be reversed. In connection with either of these operations, ambient air is drawn into conduit 54 and possibly also conduit 56 if fans 72 and 74 are operating. This ambient air is then circulated through conduits 54 and 56 so as to be expelled from the conduit through inlet openings 66 and 70, respectively. The air expelled from the conduits is directed along a path up and away from the display case. This ambient air serves to defrost the evaporator coil 58 along with any other frost buildup within conduit 54. In another modification of the embodiments of the display case illustrated in FIG. 6, it is possible to draw ambient air into conduit 56 and then divert such air into conduit 54 while maintaining the same direction of air flow through conduit 54 as the direction of air flow during a refrigeration cycle. Such an operation is discussed in connection with the three conduit display cases discussed further below.

In FIGS. 7, 8, 9 and 10*a*, there are illustrated several embodiments of a three conduit shop around refrigerated display case 76. More specifically, FIG. 7 illustrates the general embodiment of display case 76 when it is operated in a refrigeration cycle of operation, while FIGS. 8, 9 and 10*a* illustrate various embodiments of the display case when operated in a defrost cycle of operation.

Display case 76 has a top section 48, a bottom section 50 and a conduit portion 52 that interconnects top 48 and bottom 50 and extends into such sections. Many of the portions of display case 76 are the same or at least similar to the two-conduit display case 46 as previously described above. The major distinction is the inclusion of a third, outer conduit 78 that serves to establish an ambient air curtain that protects both the refrigerated air curtain and the secondary air curtain.

In the same manner as with display case 46, during the refrigeration cycle of operation of display case 76 air is circulated through conduit 54 and is refrigerated by evaporator coil 58. The refrigerated air then is emitted from outlet opening 64 and received back into the conduit through inlet opening 66 thereby establishing a refrigerated air band with a refrigerated air curtain within the display case. A secondary air curtain is established by the air circulated through conduit 56 by fans 72 and 74 and emitted from that conduit through outlet opening 68. The air emitted from conduit 56 then is received back into that conduit through inlet opening 70.

Surrounding the outside of conduit 56 is a third air conduit 78. Conduit 78 has fans 80 positioned at its upper end at the top of the display case which draws ambient air into the conduit. The ambient air is then emitted from conduit 78 through outlet opening 82. Such ambient air is directed along a substantially vertical path positioned outwardly of the refrigerated air curtain and the secondary air curtain. The ambient air falls outside of the display case and is not returned into any of the conduits for recirculation. The ambient air curtain that is formed serves as a further shield for protecting, i.e. thermally isolating, the two inner air curtains thereby enabling more efficient operation of the display case. Such efficiency in operation is especially significant if the display case is to be operated as a frozen food case. Due to the large access opening of the shop around cases of the present invention, especially those having an access opening extending through an entire 360°, the problems of properly maintaining the temperature of the food within the display cases becomes especially difficult. Thus, the provision of both the secondary air curtain and the ambient air curtain increases the thermal isolation of the refrigerated air curtain thereby substantially preventing any warming of such refrigerated air curtain by the ambient air surrounding the display case.

During the defrost operation, the air flow through the refrigerated air conduit 54 can be reversed, in the same manner as discussed above with respect to display case 46. By reversing the direction of air flow through conduit 56, ambient air is drawn into the conduit. Such ambient air then can be diverted into conduit 54 with the direction of air flow through conduit 54 remaining unchanged. Thus, as shown in FIG. 8, a plurality of perforations 88 are provided in common wall portion 86 between conduits 54 and 56. Thus, the ambient air that is circulated through conduit 56 will pass through perforations 88 into conduit 54. The ambient air is then circulated through conduit 54 and passes through evaporator coils 58 thereby serving to defrost both the evaporator coils and any frost buildup within the conduit.

In the display case illustrated in FIG. 9, adjacent each of the perforations 88 in common wall 86, there is arranged a guide fin 90. Guide fin 90 helps to divert the ambient air from air conduit 56 into air conduit 54 during the defrost cycle of operation of display case 76. Alternatively, a single opening 92 can be provided in common wall 86 and an air scoop 94 can be arranged within such opening, as illustrated in FIG. 10*a*. Air scoop 94, which is illustrated in FIG. 10*b*, serves to divert the ambient air from air conduit 56 into air conduit 54 during a defrost cycle of operation.

During the defrost cycle of operation of display case 76, fans 80 can be either stopped so that no air is propelled through conduit 78 and emitted from opening 82, or can continue in operation. If the operation of fan 80 is to continue, then the fan can be operated at a lower speed so that a smaller amount of ambient air is emitted from opening 82 and such air is not emitted with a great deal force for propelling it towards the floor. In this manner, the suction created at outlet opening 68 by the reverse operation of fans 72 and 74 then can draw in the ambient air emitted from opening 82.

In connection with all of those embodiments discussed above, the number of fans provided in any of the air conduits can vary. The number of fans utilized depends both on the size of the conduit and the size of the fans. In order to enable the defrost operation to occur at a fairly rapid rate, the ambient air flow during such cycle of operation can be increased so that a greater quantity of air moves through the refrigerated air conduit during a defrost cycle of operation then the quantity of air flow during a refrigeration cycle of operation. This increase in air flow can be on the order of between 25% and 50%. The evaporator coil that is provided in the top section of the display cases can be a curved unit that approximately conforms to the cross sectional shape of the top section of the display cases.

During the refrigeration cycle of operation, as the air passes across the access opening, such air can pick up moisture from the surrounding atmosphere. Such moisture can cause condensation at the inlet and outlet openings and lead to frost buildup. If the display cases are operated as frozen food cases, the transformation of the condensation into frost occurs immediately when the moist air passes through the grilles at the outlet and inlet openings. In order to avoid or at least significantly minimize such frost buildup a plurality of liquid lines 84 and 85 can be provided at the inlet and outlet openings, respectively. Such liquid lines are interconnected with the lines for the refrigerant flowing through the evaporator coils. These liquid lines serve to raise the areas of the grilles at the inlet and outlet openings slightly above the dew point, thereby minimizing the buildup of frost. While such lines only have been illustrated in FIG. 7, they can be utilized in any of the embodiments of the present invention.

Instead of utilizing liquid lines 84 and 85, lines carrying hot gaseous refrigerant can be employed. Such hot gas lines will serve the same function and operate in essentially the same manner as liquid lines 84 and 85. The liquid refrigerant flowing through the liquid lines is drawn from the condenser and generally is at a temperature of approximately 100° F. The gaseous refrigerant flowing through the hot gas lines is drawn from the compressor before being fed to the condenser and generally is at a temperature of approximately 200° F.

In addition to being utilized for minimizing condensation and frost buildup around the grilles, the liquid lines and hot gas lines can be used for eliminating the condensation that accumulates during the defrost cycle of operation. In order to accumulate the condensation generated during the defrost cycle of operation, a drip pan can be provided in the top of the bottom section, such as section 50 in FIG. 7. The condensation will drip into the conduits and run through a drain 51 in the conduits; to allow for such draining, a drain opening between the conduits can be provided. The liquid flowing through drain 51 is collected in a pan 53. By extending a portion of either the liquid lines or the hot gas lines through pan 53, the accumulated liquid will be vaporized. This vapor then can be expelled from the display case by creating an air flow through the bottom section. In order to enable such an air flow to occur, the sides of the bottom section are covered with a screen material.

In FIGS. 11 through 13, there are illustrated shop around refrigerated display cases 96 in each of which the access opening extends from one side of the case through the case to the opposite side so that the products on the display shelves can be reached from either of the opposing sides of the case. Display case 96 includes a top section 98, a bottom section 100, and side walls 102 and 104. Display case 96 has access openings 105 and 106 which form a continuous opening through the case from one side to the other. Arranged inside of the display case are a plurality of shelves such as shelves 108 and 110. The air conduits for circulating air through the display case extend through the bottom section of the case, along the side walls and into the top section of the display case. Separate air circulation paths can be provided for creating a refrigerated air curtain across each of openings 105 and 106, such as shown in FIGS. 12 and 13. Thus, air conduit 112 can extend through the bottom section of the case, along side wall 102 and into the top section of the case. Air conduit 114, on the other hand, extends through the bottom section of the display case, along side wall 104 and into the top section of the case.

Arranged within conduit 112 is a first evaporator coil 128 and a fan 124. Conduit 112 has an outlet opening 116 and air inlet opening 118. During a refrigeration cycle of operation, air is circulated through conduit 112 so as to be refrigerated by evaporator coil 128 and such refrigerated air is expelled through outlet opening 116 in a substantially vertical path along opening 105. Such refrigerated air then is returned to the air conduit through inlet opening 118 where it is again recirculated. Similarly, air is circulated through conduit 114 by fan 126 so as to be refrigerated by evaporator coil 130. The air circulated through conduit 114 is expelled out of opening 120 and received back into the conduit through opening 122 for recirculation. In order to shield the refrigerated air curtains from the ambient air surrounding the display case, an outer ambient air conduit 138 can be provided such as shown in FIG. 12. Ambient air is drawn into conduit 138 by a fan 142 through an opening 144 in the conduit. Such air is then expelled from the conduit through openings 140 and 141 in a substantially vertical direction adjacent to but arranged outwardly from the refrigerated air curtains. Such ambient air flows outside of the display case onto the floor and does not enter the refrigerated air conduit for recirculation.

The shop around cases illustrated in FIGS. 11, 12 and 13 can be made to be self-contained units by providing a compressor 132, a condenser 134 and a fan 136 in the bottom of the display case. By making the display case self-contained, the case can be placed anywhere in the store and thus used for spot displays.

In order to operate display case 96 in a defrost cycle of operation, the direction of air flow through conduits 112 and 114 can be reversed by reversing the direction of operation of fans 124 and 126. In this manner, ambient air is then drawn into the conduits and such ambient air is circulated through the conduits in order to defrost evaporator coils 128 and 130. This operation is substantially the same as the defrost cycle of operation discussed above with respect to the other shop around refrigerated display cases of the present invention.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims, therefore, are intended to be embraced therein.

What is claimed is:

1. A refrigerated display case comprising:

a cabinet having top and bottom sections and air conduit means coupling said top and bottom sections and said cabinet having an opening therein between said top and bottom sections, said opening circumscribing an angle of at least approximately 90°;

said conduit means having a vertically extending portion located approximately at the center of radius of said cabinet and extending into both said top and bottom sections, said conduit means including a first air conduit and a second air conduit;

said first air conduit passing through said conduit means and having at opposing ends thereof an air outlet opening and an air inlet opening, said air outlet opening and said air inlet opening being in alignment for establishing an inner air curtain across said opening in said cabinet;

said second air conduit passing through said conduit means and lying so as to be at least partially surrounded by said first air conduit in said vertically extending portion thereof and said second air conduit having at opposing ends thereof an air outlet opening and an air inlet opening lying outside of said air outlet and inlet openings of said first air conduit, said air outlet opening and said air inlet opening being in alignment for establishing a second air curtain across said opening in said cabinet, such second air curtain being directed along a path spaced outwardly of the inner air curtain;

first air band establishing means for circulating air through said first air conduit and forming an air band of refrigerated air within said display case, said first air establishing means including first air propelling means arranged within said first air conduit for propelling air through said first air conduit and refrigeration means for cooling air passing through said first air conduit and such cool air being expelled from said air outlet opening of said first air conduit and received by said inlet opening of said first air conduit so as to establish a band of refrigerated air with an inner air curtain across said opening in said cabinet;

second air band establishing means for establishing a band of non-refrigerated circulating air in said second air conduit and including second air propelling means for propelling air through said second air conduit such that such air leaving said outlet opening of said second air conduit passes across said opening in said cabinet and is received by said inlet opening of said second air conduit, thereby establishing a secondary air band with the second air curtain across said opening in said cabinet; and defrost means for deactivating said refrigeration means and causing ambient air to circulate through said first air conduit for defrosting said refrigeration means.

2. A display case according to claim 1 wherein during a refrigeration cycle of operation said first air band establishing means and said second air band establishing means generate air bands in said first air conduit and said second air conduit, respectively, that flow in the same direction.

3. A display case according to claim 2 wherein during a defrost cycle of operation, said defrost means causes air to flow through said second air conduit in a reverse direction and ambient air to be drawn into said second air conduit and said defrost means diverts a portion of such ambient air from said second air conduit into said first air conduit.

4. A display case according to claim 3 wherein the portions of said first and second air conduits lying in said bottom of said display case share a common wall and said common wall has at least one opening therein so that ambient air can pass through said opening.

5. A display case according to claim 1 wherein said defrost means causes ambient air to flow in a reverse direction in said first air conduit during a defrost cycle as compared to the air flow direction of the refrigeration air during a cycle of operation.

6. A display case according to claim 1 further comprising a third air conduit arranged outwardly of said first and second air conduits and having an outlet opening adjacent to said outlet openings of said first and second air conduits and third air propelling means for propelling ambient air through said third air conduit so that ambient air is expelled from said third air conduit in a direction for forming an ambient air curtain lying outside of the inner and secondary air curtains.

7. A refrigerated display case comprising:

a cabinet having top and bottom sections and air conduit means interconnecting said sections and said cabinet having an opening therein between said top and bottom sections for enabling access to refrigerated products displayed on a plurality of shelves arranged within said refrigerated display case, said opening circumscribing an angle of at least approximately 90°;

said conduit means having a vertically extending portion located approximately at the center of radius of said cabinet and said conduit means including an air outlet opening and an air inlet opening at opposing ends thereof, said air outlet opening and air inlet opening being aligned so that air being expelled from said air outlet opening is received by said air inlet opening;

air band establishing means for propelling air through said air conduit means and forming a band of refrigerated air within said refrigerated display case including a curtain of refrigerated air across said opening in said cabinet during a refrigeration cycle, said air band establishing means including air propelling means for propelling air through said air conduit means and refrigeration means for cooling the air being propelled through said air conduit means during a refrigeration cycle of operation; and defrost means including means for turning off said refrigeration means and causing ambient air to flow through said air conduit means in a direction opposite to the direction of refrigerated air flow during a refrigeration cycle so that the ambient air is drawn into said air conduit through said air outlet opening for defrosting said refrigeration means during a defrost cycle of operation.

8. A display case according to claim 7 further comprising second air establishing means for creating a curtain of non-refrigerated air along a path adjacent to and spaced outwardly of the refrigerated air curtain.

9. A display case according to claim 7 wherein said defrost means causes a greater quantity of air to flow through said air conduit means during a defrost cycle than the air flow during said refrigeration cycle.

10. A refrigerated display case comprising:

a cabinet having top and bottom sections and air conduit means coupling said top and bottom sections and said cabinet having an opening therein between said top and bottom sections, said opening circumscribing an angle of at least approximately 90°;

said conduit means having a vertically extending portion located approximately at the center of radius of said cabinet and said conduit means including a first air conduit and a second air conduit;

said first air conduit having arranged in alignment an air outlet opening and an air inlet opening for establishing an inner air curtain across said opening in said cabinet;

said second air conduit having arranged in alignment an air outlet opening and an air inlet opening for establishing a secondary air curtain across said opening in said cabinet, with the secondary air curtain lying outwardly of the inner air curtain;

first air band establishing means for propelling air through said first air conduit and forming a band of refrigerated air within said display case, said first air band establishing means including first air propulsion means arranged within said first air conduit for propelling air through said first air conduit and refrigeration means for cooling air passing through said first air conduit and such cool air being expelled from said outlet opening of said first air conduit and received by said inlet opening of said first air conduit so as to establish a band of refrigerated air;

second air band establishing means for propelling air through said second air conduit so that such air leaves said outlet opening of said second air conduit and passes across said opening in said cabinet along a path lying outside of said band of refrigerated air and is received by said inlet opening of said second air conduit so as to establish a secondary air band with the secondary air curtain; and defrost means including means for turning off said refrigeration means during a defrost cycle of operation and said defrost means causing ambient air to flow through said second air conduit in a reverse direction and ambient air to be drawn into said second air conduit and said defrost means including means for divertng a portion of such ambient air from said second air conduit into said first air conduit for causing ambient air to flow through said first air conduit for defrosting said refrigeration means.

11. A display case according to claim 10 further comprising a compressor and a condenser so that said display case is a self-contained free standing unit.

12. A display case according to claim 10 or 11 wherein: during a refrigeration cycle of operation said first air establishing means and said second air band establishing means generate air bands in said first conduit and said second conduit that flow in the same direction.

13. A display case according to claim 12 wherein the portions of said first and second air conduits lying in said bottom section of said display case share a common wall and said common wall has at least one opening therein so that ambient air can pass through said opening.

* * * * *